US010512343B1

(12) United States Patent
Podach et al.

(10) Patent No.: US 10,512,343 B1
(45) Date of Patent: Dec. 24, 2019

(54) RIBBON MEDICAL DISPLAY

(71) Applicant: Run like the Wind, LLC, Virginia Beach, VA (US)

(72) Inventors: Donald P. Podach, Virginia Beach, VA (US); Anja M. Hendricks, Virginia Beach, VA (US)

(73) Assignee: Run like the Wind, LLC, Virginia Beach, VA (US)

( * ) Notice: Subject to any disclaimer, the term of this patent is extended or adjusted under 35 U.S.C. 154(b) by 0 days.

(21) Appl. No.: 16/217,115

(22) Filed: Dec. 12, 2018

(51) Int. Cl.
*A47F 7/02* (2006.01)
*A47F 5/16* (2006.01)
*A44C 3/00* (2006.01)

(52) U.S. Cl.
CPC ..... *A47F 7/02* (2013.01); *A47F 5/16* (2013.01); *A44C 3/004* (2013.01)

(58) Field of Classification Search
CPC . A47F 7/02; A47F 5/16; A47F 5/0892; A47B 43/003; A47B 43/006; A44C 3/004; G09F 15/0031
USPC ..... 211/85.2, 113, 184; 248/317, 343, 344, 248/318; 40/650, 606.12; 206/6.1; 108/28, 29, 149
See application file for complete search history.

(56) References Cited

U.S. PATENT DOCUMENTS 288,853 A * 11/1883 Poage ..... A47F 5/0823 211/57.1
402,885 A * 5/1889 Babcock ..... A47G 25/743 211/113
405,257 A * 6/1889 Harris ..... A47G 25/743 211/113
476,029 A * 5/1892 Altman ..... A47G 25/743 211/113
487,246 A * 12/1892 Bunker ..... F21V 21/02 248/343
504,233 A * 8/1893 McVey ..... A47B 65/00 211/43
D27,923 S * 11/1897 Robbins ..... D6/514
644,728 A * 3/1900 Biester ..... A47F 5/0892 211/117
819,338 A * 5/1906 Claridge ..... G09F 7/18 40/607.13
1,211,286 A * 1/1917 Carney ..... A47B 43/006 108/164
1,345,158 A * 6/1920 Frank ..... A47F 5/0892 211/117

(Continued)

*Primary Examiner* — Jonathan Liu
*Assistant Examiner* — Devin K Barnett
(74) *Attorney, Agent, or Firm* — Shaddock Law Group, PC

(57) ABSTRACT

A medal display having at least some of a display base having a first side and a second side and extending from a proximate center to an outer edge; a plurality of elongate slots formed through the display base, wherein the elongate slots are formed in corresponding, adjacent pairs of substantially parallel elongate slots, wherein the corresponding, adjacent pairs of elongate slots are arranged at spaced apart locations so as to form an outer slot arrangement and an inner slot arrangement; and one or more attachment elements formed in, on, or through the display base, wherein each attachment element is formed such that one or more suspension cords may interact with each of the attachment elements, such that the display base may be suspended from the one or more suspension cords.

13 Claims, 13 Drawing Sheets

(56) References Cited

U.S. PATENT DOCUMENTS 1,562,381 A * 11/1925 Stoyka ..... G07F 11/00 211/113
2,118,444 A * 5/1938 Mueller ..... A47F 5/005 211/131.1
2,271,941 A * 2/1942 Kemmitt ..... A47B 61/003 211/118
2,492,226 A * 12/1949 Kohl ..... A47G 25/743 211/85.3
D160,688 S * 10/1950 Brock ..... D7/501
2,646,195 A * 7/1953 Kleist ..... A47G 25/26 223/88
3,028,949 A * 4/1962 Sohosky ..... A45C 1/10 206/0.83
3,081,058 A * 3/1963 De Vries ..... A47F 5/0892 248/318
3,134,484 A * 5/1964 Cox ..... A47G 1/12 206/778
3,304,142 A * 2/1967 Rockola ..... G07F 9/10 312/205
3,339,745 A * 9/1967 Sugerman ..... A47F 7/02 211/85.2
3,382,819 A * 5/1968 Davidson ..... A47B 5/02 108/23
3,479,760 A * 11/1969 Snyder, Jr. ..... G09F 7/20 40/606.12
3,703,779 A * 11/1972 Goldman ..... G09F 13/04 40/615
3,727,771 A * 4/1973 Hoffman ..... B25H 3/003 211/69
3,750,917 A * 8/1973 Villani ..... D06C 5/005 223/74
3,868,916 A * 3/1975 Ohlson ..... A47B 49/00 108/103
3,901,165 A * 8/1975 Schlesinger ..... A47B 43/006 108/149
3,905,484 A * 9/1975 Dean ..... A47B 57/58 211/184
3,928,930 A * 12/1975 Attwood ..... G09F 7/18 40/606.12
4,121,720 A * 10/1978 Hayes ..... A47F 5/0892 211/113
4,167,908 A * 9/1979 Jones ..... A47B 47/00 108/149
4,181,234 A * 1/1980 Feighan ..... A47G 7/047 211/113
4,244,301 A * 1/1981 Nakatsu ..... A47B 43/006 108/149
4,316,545 A * 2/1982 Hartnell ..... B25H 3/06 211/113
4,329,789 A * 5/1982 Erickson ..... F26B 25/18 108/164
4,441,583 A * 4/1984 Vaught ..... E04G 3/22 182/150
4,523,526 A * 6/1985 O'Neill ..... A47B 43/006 108/149
4,534,474 A * 8/1985 Ng ..... B25H 3/04 206/501
4,830,199 A * 5/1989 Wolfe ..... A47F 5/0031 211/113
4,974,523 A * 12/1990 Giarratana ..... A47B 43/006 108/42
5,004,633 A 4/1991 Lovik
5,086,920 A * 2/1992 Binienda ..... B65D 19/44 206/335
5,503,587 A * 4/1996 Mellen ..... G09B 23/10 248/318
5,524,775 A * 6/1996 Kaine ..... A47B 49/004 108/103
5,564,566 A * 10/1996 Lamb ..... B25H 3/00 206/349
5,588,295 A * 12/1996 Brotz ..... F03G 7/065 60/527
5,617,663 A * 4/1997 Miki ..... A47G 1/14 40/650
5,749,479 A * 5/1998 Belokin ..... A47F 5/0892 211/113
5,941,252 A * 8/1999 Jenkins ..... A47B 49/00 132/73
6,000,547 A * 12/1999 Ovadia ..... A47F 7/02 206/566
6,006,899 A * 12/1999 McAuley ..... G09F 3/04 206/566
6,052,932 A * 4/2000 Reddig ..... G09F 15/0087 312/287
6,056,130 A * 5/2000 Ovadia ..... A47F 7/02 206/566
6,133,121 A * 10/2000 Tsunashima ..... C23C 16/4583 118/500
6,286,691 B1 * 9/2001 Oberhaus ..... A47F 5/0892 211/113
6,389,991 B1 * 5/2002 Morrisson ..... A47B 57/585 108/61
6,817,129 B1 11/2004 Purdy
6,820,853 B1 11/2004 DuBarry
6,886,282 B2 * 5/2005 Sumner ..... G09F 15/0025 40/593
7,015,815 B1 * 3/2006 Feibelman ..... G08B 13/2434 206/6.1
D535,909 S 1/2007 Banman
7,367,145 B2 * 5/2008 Mou ..... G09F 13/00 215/379
7,485,788 B2 2/2009 Fennell et al.
7,588,165 B2 * 9/2009 Prichard ..... G07F 5/26 221/120
7,726,495 B1 6/2010 Merbeth
7,762,862 B2 * 7/2010 Rotundo ..... A63H 3/52 434/72
7,770,305 B1 * 8/2010 Krauss ..... D06F 57/12 211/104
7,770,313 B2 * 8/2010 Fritsche ..... G09F 15/0068 40/600
7,789,249 B1 9/2010 Merbeth
7,913,966 B2 * 3/2011 Nordbrock ..... E04B 9/18 248/343
D638,262 S * 5/2011 Eberstadt, Jr. ..... D7/554.2
7,987,988 B2 8/2011 Johnson et al.
8,015,737 B2 * 9/2011 Venegas, Jr. ..... E01F 15/003 40/606.12
8,256,151 B2 * 9/2012 Stafford ..... G09F 7/18 40/606.12
D692,793 S 11/2013 Stoppler
8,720,705 B1 5/2014 Merbeth
8,828,509 B2 9/2014 Stoeppler
8,881,441 B2 * 11/2014 Thornton ..... A47G 1/12 206/6.1
8,998,010 B1 * 4/2015 Kennedy ..... A47B 47/0091 211/115
D747,895 S 1/2016 Florek
10,062,365 B2 8/2018 Finigan
10,093,453 B1 * 10/2018 Taylor ..... B65D 25/22
2002/0179556 A1 * 12/2002 Osawa ..... A47F 5/005 211/184
2004/0178706 A1 * 9/2004 D'Orso ..... A47B 43/006 312/351
2005/0023229 A1 * 2/2005 Ashley ..... A47B 43/006 211/38
2006/0084045 A1 4/2006 Banman
2006/0165529 A1 * 7/2006 Sobel ..... F04D 25/088 416/210 R
2007/0045207 A1 * 3/2007 Kollory ..... A47F 7/12 211/113
2007/0095768 A1 * 5/2007 Huo ..... A47B 45/00 211/113
2009/0255883 A1 * 10/2009 Boyd ..... A47F 5/02 211/70
2011/0147236 A1 * 6/2011 Johnson ..... A45C 11/16 206/6.1

(56) References Cited

U.S. PATENT DOCUMENTS

| | | | | |
|---|---|---|---|---|
| 2012/0186119 | A1* | 7/2012 | Pitcher | G09F 15/0018 40/605 |
| 2013/0134111 | A1 | 5/2013 | Florek | |
| 2013/0153731 | A1* | 6/2013 | Engstrom | F21V 21/03 248/343 |
| 2014/0173950 | A1 | 6/2014 | Neri | |
| 2014/0262846 | A1* | 9/2014 | Comstock | D04D 1/04 206/6.1 |
| 2015/0257551 | A1* | 9/2015 | Trainor-Smith | A47F 7/02 211/85.2 |
| 2016/0150895 | A1* | 6/2016 | Conley | A47G 25/14 211/85.2 |
| 2017/0278435 | A1* | 9/2017 | Shea | G09F 23/06 |

* cited by examiner

RIBBON MEDICAL DISPLAY

CROSS-REFERENCE TO RELATED APPLICATIONS

None.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of display devices. More specifically, the present disclosure relates to an improved display devices for ribbon medals.

2. Description of Related Art

It is common for people who participate in sporting or other events, such as, for example, athletes, runners, adventure racers, etc., to accumulate ribbon medals for their participation in various events. It is common for people to attempt to display their ribbon medals in various manners. Currently, ribbon medals are pinned to cork boards or hung from portions of dowel rod.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, there does not currently exist a relatively compact, organized way to display ribbon medals. Furthermore, there does not currently exist a manner in which ribbon medals can be displayed to optionally provide a wind chime or similar device.

The medal display of the present disclosure is directed to a display, primarily for neck ribbon medals. A display rack includes a plurality of closed slots, formed in pairs, through the display rack. The pairs of closed slots are formed at spaced apart locations of the display rack. The ribbon portion of the neck ribbon medals may be positioned through adjacent slots to secure each neck ribbon medal to the display rack. When a number of neck ribbon medals have been appropriately positioned, the display rack can act as a wind chime. The display rack may optionally have a generally circular shape, or any other desired shape. A display panel may also optionally be included, which may be attached or coupled to the display rack to provide an area for personalization or application of stickers, etc.

The disadvantages and shortcomings of the prior art are overcome by the features and elements of the medal display of the present disclosure. The advantages of the present disclosure are preferably attained by providing, in certain exemplary, nonlimiting embodiments, a medal display, comprising a display base having a first side and a second side and extending from a proximate center to an outer edge; a plurality of elongate slots formed through the display base, wherein the elongate slots are formed in corresponding, adjacent pairs of substantially parallel elongate slots, wherein the corresponding, adjacent pairs of elongate slots are arranged at spaced apart locations so as to form an outer slot arrangement and an inner slot arrangement; and one or more attachment elements formed in, on, or through the display base, wherein each attachment element is formed such that one or more suspension cords may interact with each of the attachment elements, such that the display base may be suspended from the one or more suspension cords.

In various exemplary, nonlimiting embodiments, a central aperture is formed proximate the proximate center of the display base.

In various exemplary, nonlimiting embodiments, the display base has a substantially round, oval, triangular, square, rectangular, or other geometrically defined or unique overall shape.

In various exemplary, nonlimiting embodiments, each elongate slot has an overall round, oval, triangular, square, rectangular, or other defined or unique shape.

In various exemplary, nonlimiting embodiments, each elongate slot is formed so as to extend radially from the proximate center of the display base.

In various exemplary, nonlimiting embodiments, the corresponding, adjacent pairs of elongate slots are formed so as to extend radially from the proximate center of the display base.

In various exemplary, nonlimiting embodiments, the outer slot arrangement comprises a plurality of corresponding, adjacent pairs of elongate slots formed in a spaced apart circular arrangement proximate the outer edge of the display base.

In various exemplary, nonlimiting embodiments, the inner slot arrangement comprises a plurality of corresponding, adjacent pairs of elongate slots formed in a substantially circular arrangement proximate the center of the display base.

In various exemplary, nonlimiting embodiments, the inner slot arrangement and the outer slot arrangement form concentric circles, with the inner slot arrangement being disposed within the outer slot arrangement.

In various exemplary, nonlimiting embodiments, the medal display further comprises one or more accessory slots formed through the display base at spaced apart locations, proximate the outer edge of the display base, wherein each accessory slot is formed so as to interact with a portion or element of an accessory to allow the accessory to be attached or coupled to the display base.

In various exemplary, nonlimiting embodiments, a plurality of ribbon medals may be attached, utilizing corresponding, adjacent pairs of elongate slots.

In various exemplary, nonlimiting embodiments, one or more discs may optionally be suspended through or from the central aperture.

In various exemplary, nonlimiting embodiments, a medal may be suspended from the display base, via a lanyard, by urging a portion of a lanyard through an elongate slot from the second side, urging the portion of the lanyard through a corresponding, adjacent elongate slot from the first side, and inhibiting movement of the portion of the lanyard through the corresponding, adjacent elongate slot from the second side.

In various exemplary, nonlimiting embodiments, inhibiting movement of the portion of the lanyard through the corresponding, adjacent elongate slot from the second side comprises passing a medal through a loop of the end portion of the lanyard.

In various exemplary, nonlimiting embodiments, the medal display further comprises a display having a display surface, wherein at least a portion of the display is able to interact with the accessory slots to attached or coupled the display to the display base.

In still other exemplary, nonlimiting embodiments, a medal display is provided that comprises a display base having a first side and a second side and extending from a proximate center to an outer edge; a plurality of elongate slots formed through the display base, wherein the elongate slots are formed in corresponding, adjacent pairs of substantially parallel elongate slots, wherein the corresponding, adjacent pairs of elongate slots are arranged at spaced apart locations so as to form an outer slot arrangement and an inner slot arrangement; and an attachment base extending from the display base, wherein a plane formed by the attachment base is formed at a 90° angle relative to a plane formed by the first side or the second side of the display base.

In still other exemplary, nonlimiting embodiments, a medal display is provided that comprises an outer display base having a first side and a second side and extending from an inner edge to an outer edge; an inner display base having a first side and a second side and extending from a proximate center to an outer edge; a plurality of elongate slots formed through the outer display base, wherein the elongate slots are formed in corresponding, adjacent pairs of substantially parallel elongate slots, wherein the corresponding, adjacent pairs of elongate slots are arranged at spaced apart locations so as to form an outer slot arrangement; a plurality of elongate slots formed through the inner display base, wherein the elongate slots are formed in corresponding, adjacent pairs of substantially parallel elongate slots, wherein the corresponding, adjacent pairs of elongate slots are arranged at spaced apart locations so as to form an inner slot arrangement; and one or more attachment elements formed in, on, or through the outer display base in the inner display base, wherein certain of the attachment elements are formed such that one or more suspension cords may interact with the attachment elements, such that the inner display base may be suspended from the outer display base, via the one or more suspension cords.

In various exemplary, nonlimiting embodiments, the inner display base capable of being positioned within the inner edge of the outer display base.

In various exemplary, nonlimiting embodiments, certain of the attachment elements are formed such that one or more suspension cords may interact with the attachment elements, such that the outer display base may be suspended from the one or more suspension cords The presently disclosed systems, methods, and/or apparatuses separately provide a medal display that may optionally allow a user to display and view a plurality of ribbon medals.

The presently disclosed systems, methods, and/or apparatuses separately provide a medal display that may optionally be utilized as a wind chime.

The presently disclosed systems, methods, and/or apparatuses separately provide a medal display that may optionally include one or more display bases or tiers for attaching ribbon medals.

The presently disclosed systems, methods, and/or apparatuses separately provide a medal display that may optionally include a display surface.

The presently disclosed systems, methods, and/or apparatuses separately provide a medal display that can be easily assembled by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
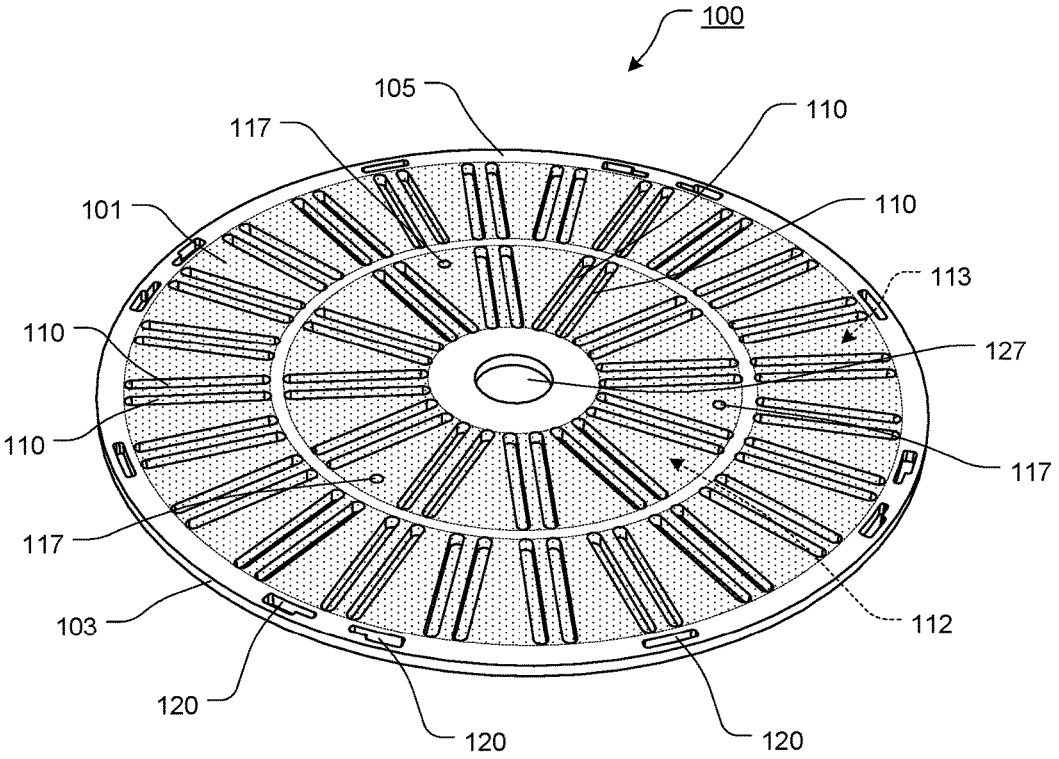
FIG. 1 illustrates an upper, perspective view of an exemplary embodiment of a medal display, according to the presently disclosed systems, methods, and/or apparatuses.
Figure 2:
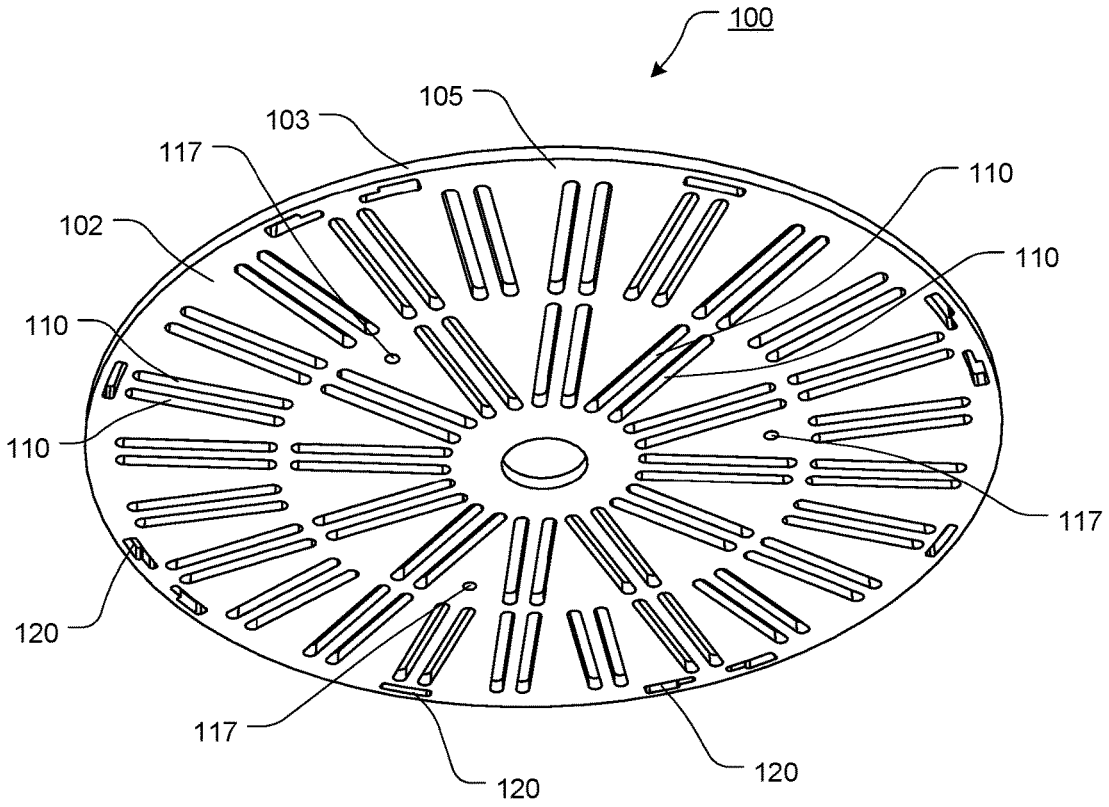
FIG. 2 illustrates a lower, perspective view of an exemplary embodiment of a medal display, according to the presently disclosed systems, methods, and/or apparatuses.
Figure 3:
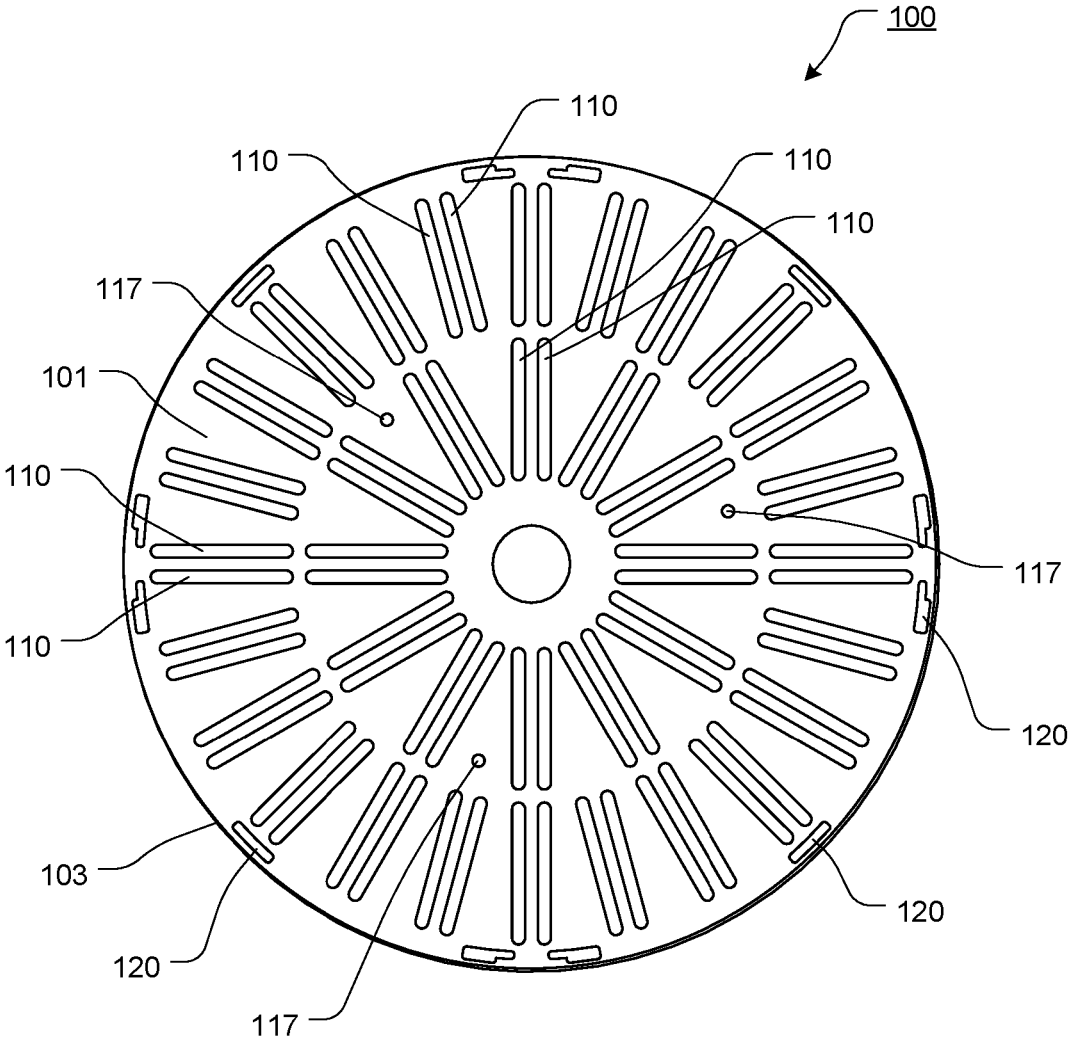
FIG. 3 illustrates a top view of an exemplary embodiment of a medal display, according to the presently disclosed systems, methods, and/or apparatuses.
Figure 4:
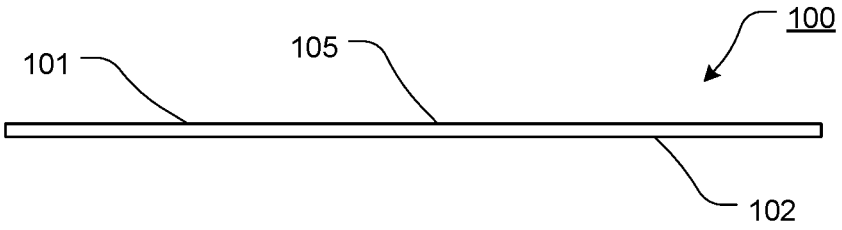
FIG. 4 illustrates a side view of an exemplary embodiment of a medal display, according to the presently disclosed systems, methods, and/or apparatuses.

For simplicity and clarification, the design factors and operating principles of the medal display according to the presently disclosed systems, methods, and/or apparatuses are explained with reference to various exemplary embodiments of a medal display according to the presently disclosed systems, methods, and/or apparatuses. The basic explanation of the design factors and operating principles of the medal display is applicable for the understanding, design, and operation of the medal display of the presently disclosed systems, methods, and/or apparatuses. It should be appreciated that the medal display can be adapted to many applications where a medal display can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "medal display", "display", "medal", and "ribbon medal" are used for basic explanation and understanding of the operation of the presently disclosed systems, methods, and/or apparatuses. Therefore, the terms "medal display", "display", "medal", and "ribbon medal" are not to be construed as limiting the systems, methods, and/or apparatuses of the present disclosure. Thus, for example, the term "ribbon medal" is to be understood to broadly include any medal, medallion, or other award or device attached or coupled to a ribbon, lanyard, band, tie, cord, or the like.

For simplicity and clarification, the medal display of the present disclosure will be described as being used in conjunction with one or more ribbon medals comprising a medal and a medal lanyard. However, it should be appreciated that these are merely exemplary embodiments of the medal display and are not to be construed as limiting the presently disclosed systems, methods, and/or apparatuses. Thus, the medal display of the present disclosure may be utilized in conjunction with any device or object suspended from a ribbon, lanyard, band, tie, cord, or the like.

Figure 5:
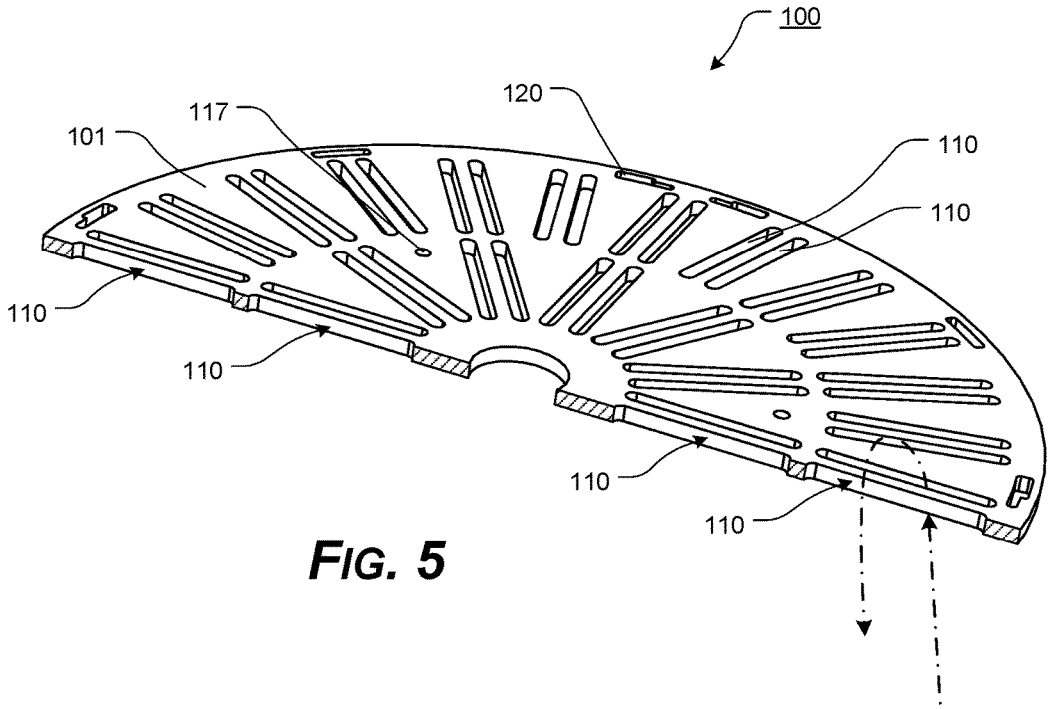
FIG. 5 illustrates an upper, perspective, cross-sectional view of an exemplary embodiment of a medal display, according to the presently disclosed systems, methods, and/or apparatuses.
Figure 6:
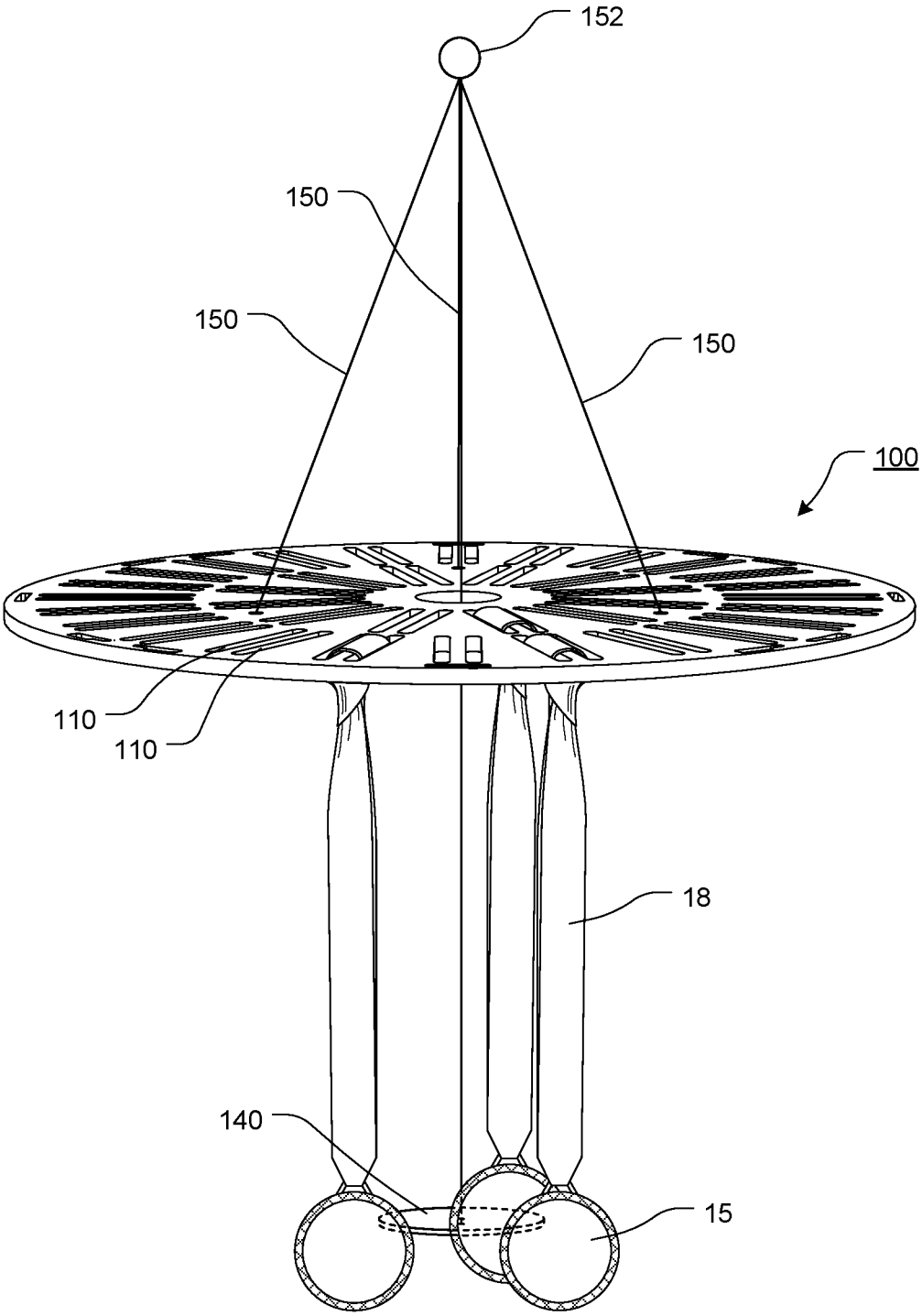
FIG. 6 illustrates an upper, perspective view of an exemplary embodiment of a medal display, wherein an exemplary ribbon medals are attached to a display base, according to the presently disclosed systems, methods, and/or apparatuses.
Figure 7:
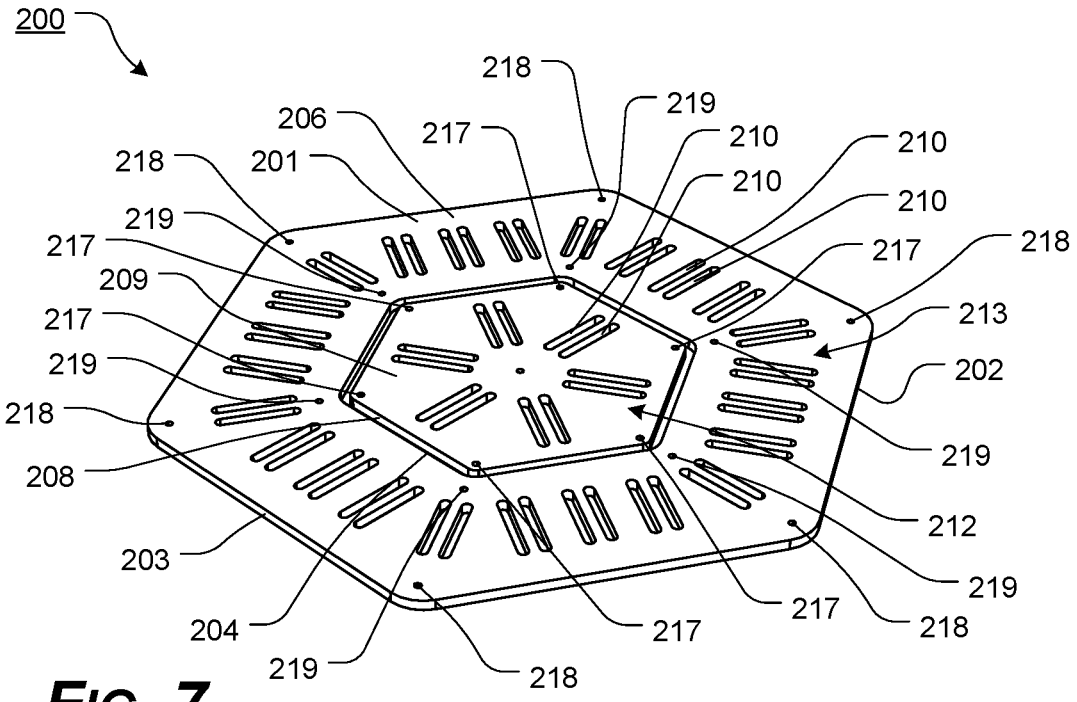
FIG. 7 illustrates an upper, perspective view of certain exemplary elements of an exemplary embodiment of a medal display, according to the presently disclosed systems, methods, and/or apparatuses.
Figure 8:
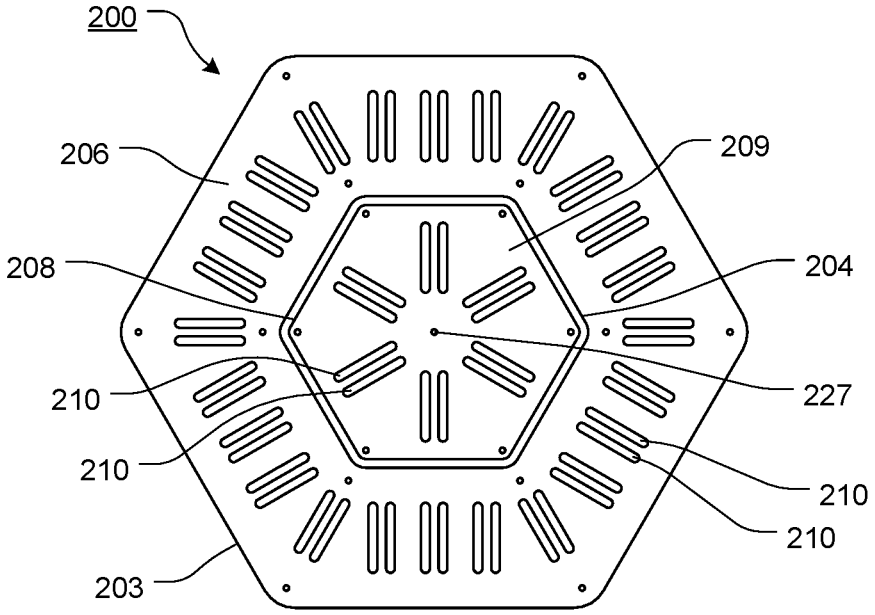
FIG. 8 illustrates a top view of certain exemplary elements of an exemplary embodiment of a medal display, according to the presently disclosed systems, methods, and/or apparatuses.
Figure 9:
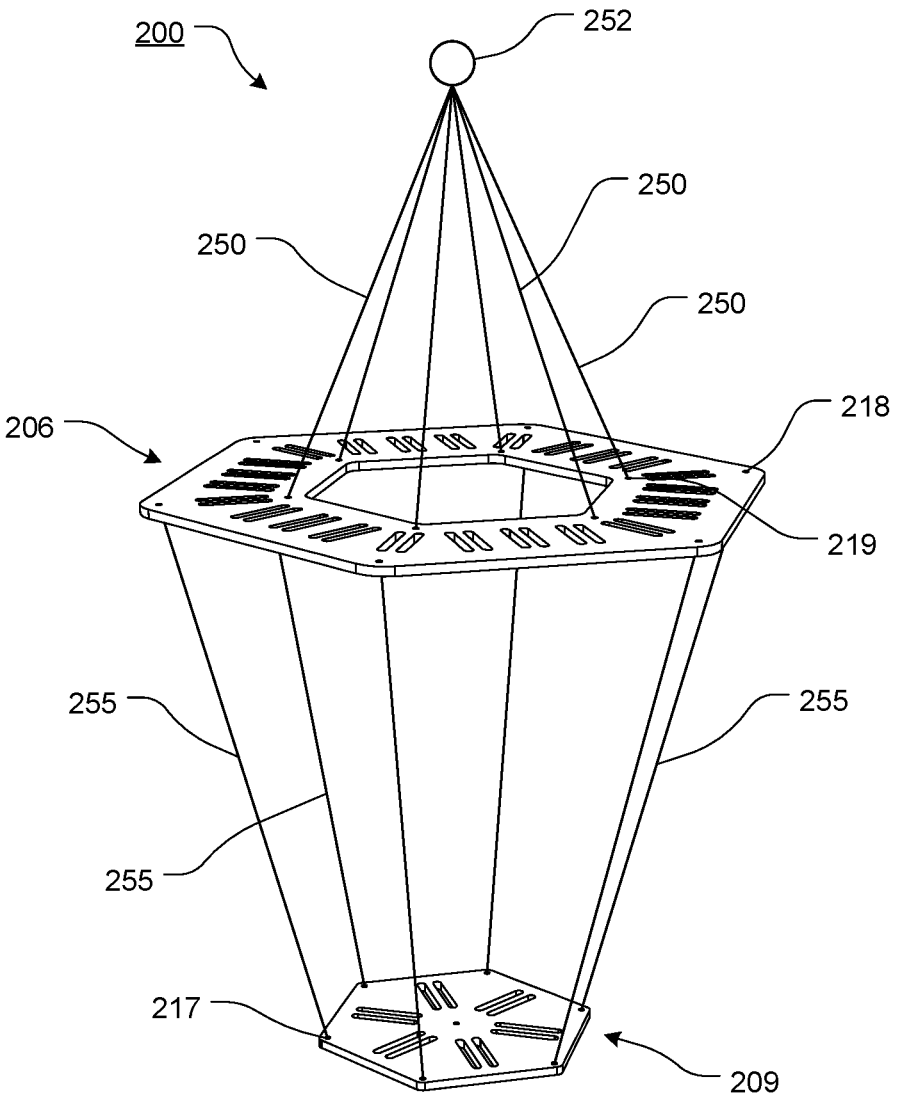
FIG. 9 illustrates an upper, perspective view of an exemplary embodiment of a medal display, according to the presently disclosed systems, methods, and/or apparatuses.
Figure 10:
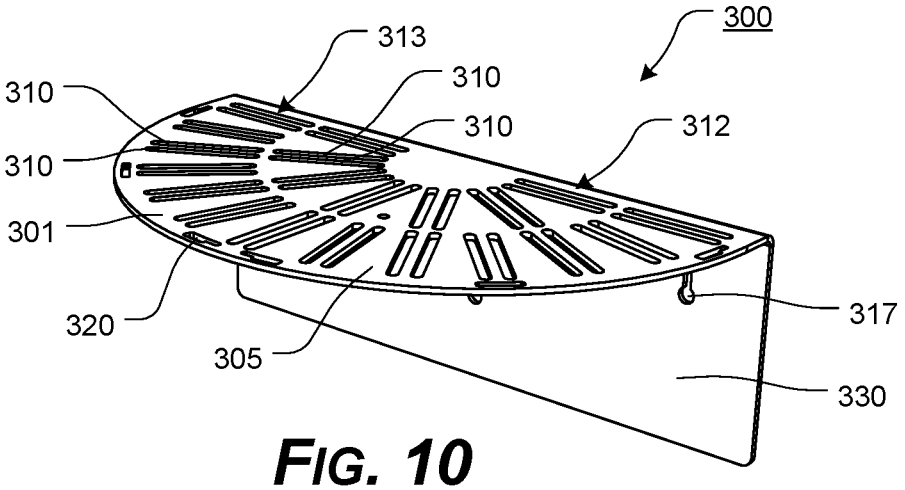
FIG. 10 illustrates an upper, perspective view of an exemplary embodiment of a medal display, according to the presently disclosed systems, methods, and/or apparatuses.
Figure 11:
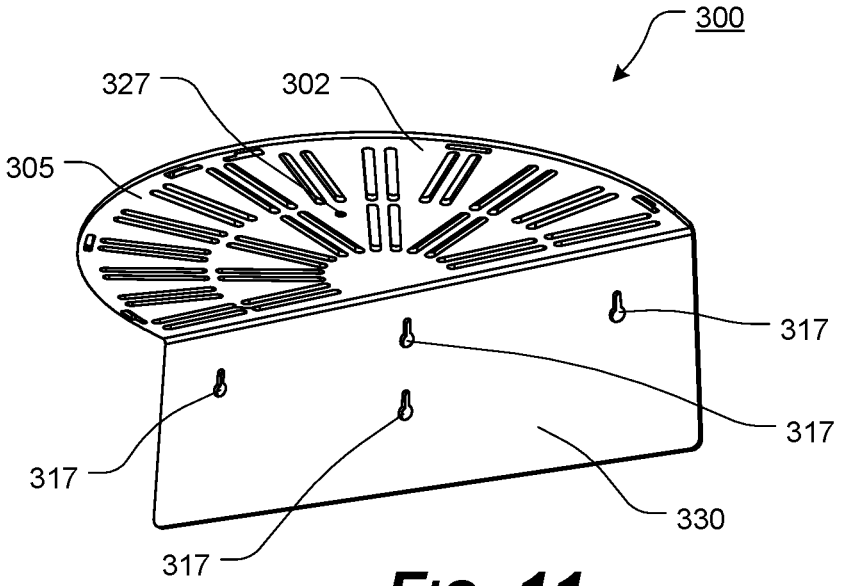
FIG. 11 illustrates a lower, perspective view of an exemplary embodiment of a medal display, according to the presently disclosed systems, methods, and/or apparatuses.
Figure 12:
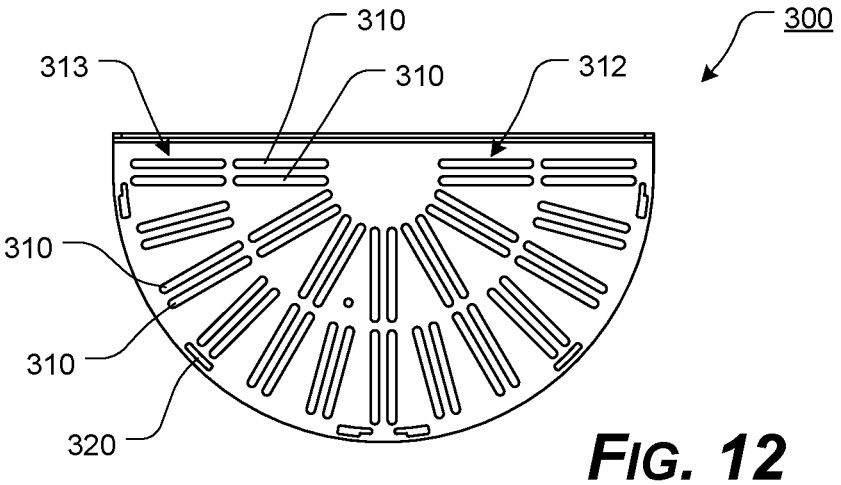
FIG. 12 illustrates a top view of an exemplary embodiment of a medal display, according to the presently disclosed systems, methods, and/or apparatuses.
Figure 13:
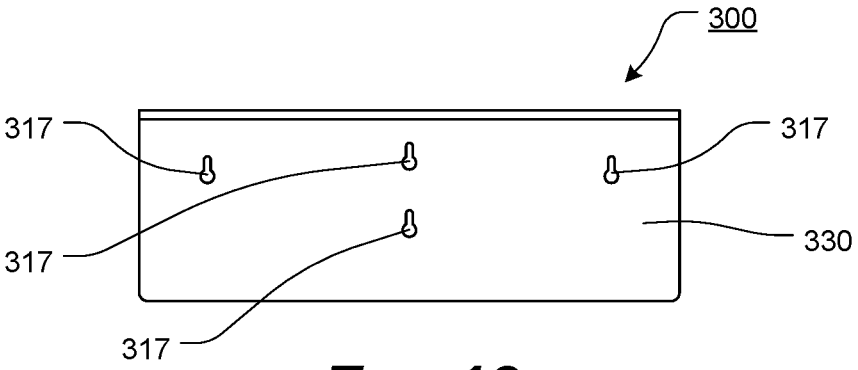
FIG. 13 illustrates a front view of an exemplary embodiment of a medal display, according to the presently disclosed systems, methods, and/or apparatuses.
Figure 14:
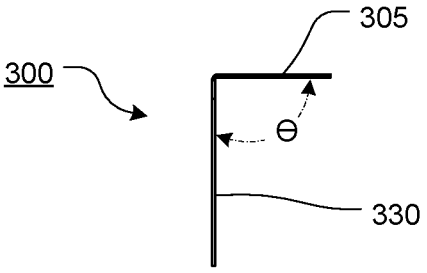
FIG. 14 illustrates a right side view of an exemplary embodiment of a medal display, according to the presently disclosed systems, methods, and/or apparatuses, it being understood that the left side view of the medal display is a mirror image of the right side view.
Figure 15:
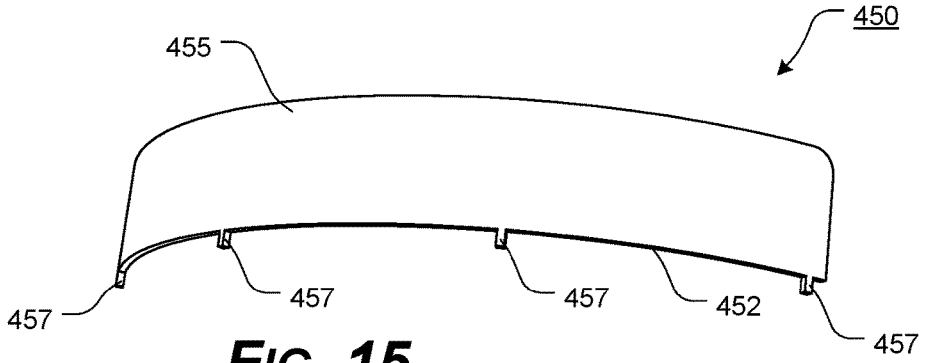
FIG. 15 illustrates a lower, front perspective view of an exemplary embodiment of a display element to be utilized in conjunction with a medal display, according to the presently disclosed systems, methods, and/or apparatuses.
Figure 16:
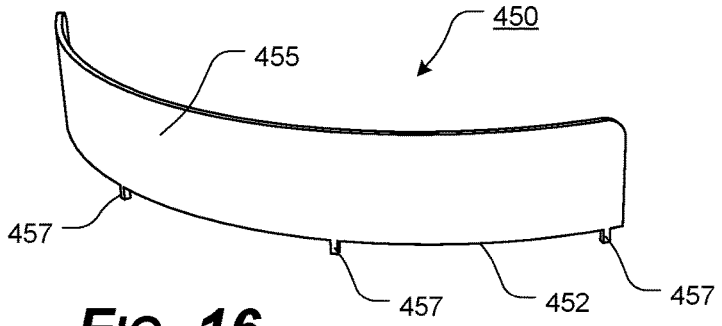
FIG. 16 illustrates an upper, front perspective view of an exemplary embodiment of a display element to be utilized in conjunction with a medal display, according to the presently disclosed systems, methods, and/or apparatuses.
Figure 17:
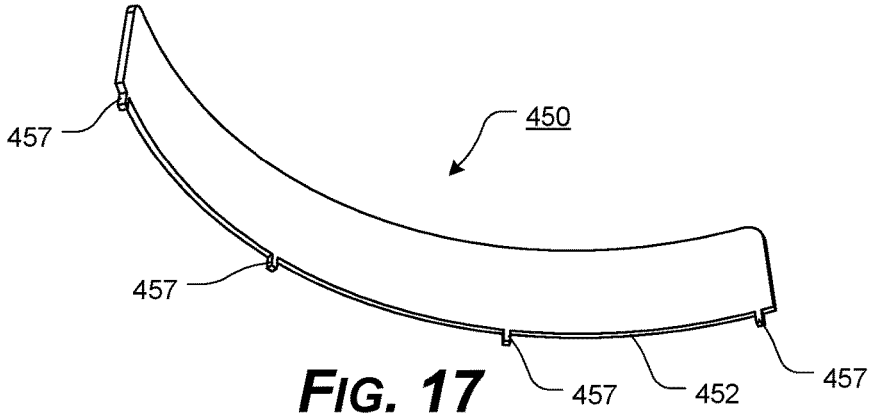
FIG. 17 illustrates a lower, rear perspective view of an exemplary embodiment of a display element to be utilized in conjunction with a medal display, according to the presently disclosed systems, methods, and/or apparatuses.
Figure 18:
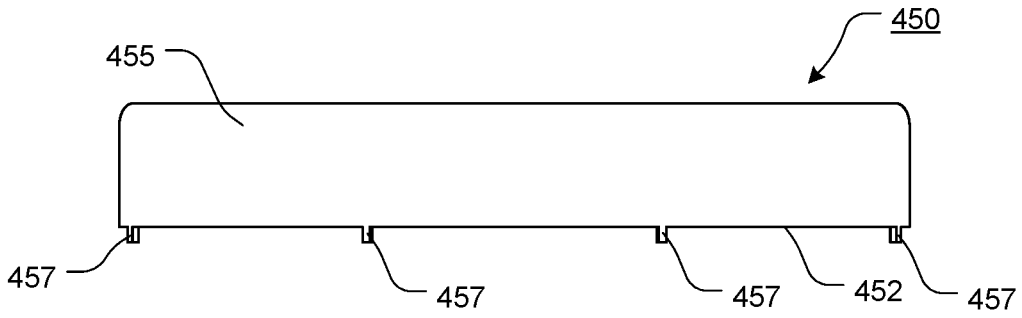
FIG. 18 illustrates a front view of an exemplary embodiment of a display element to be utilized in conjunction with a medal display, according to the presently disclosed systems, methods, and/or apparatuses.
Figure 19:
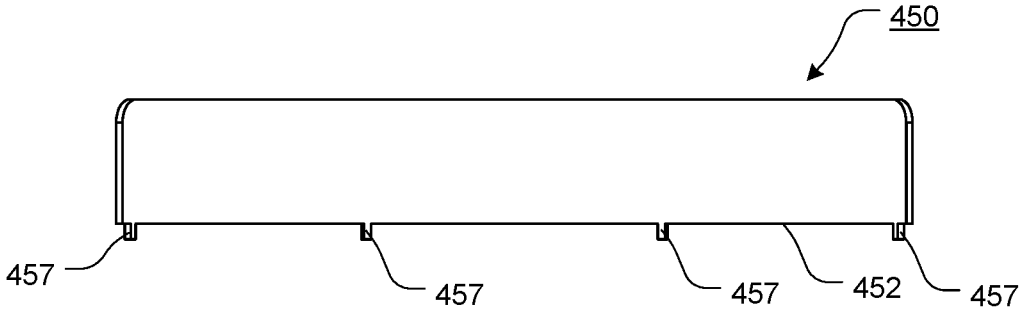
FIG. 19 illustrates a rear perspective view of an exemplary embodiment of a display element to be utilized in conjunction with a medal display, according to the presently disclosed systems, methods, and/or apparatuses.
Figure 20:
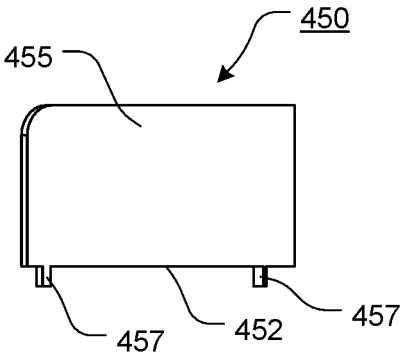
FIG. 20 illustrates a left side view of an exemplary embodiment of a display element to be utilized in conjunction with a medal display, according to the presently disclosed systems, methods, and/or apparatuses.
Figure 21:
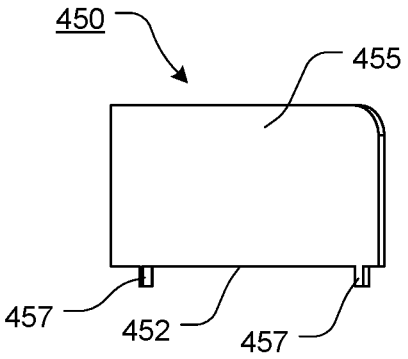
FIG. 21 illustrates a right side view of an exemplary embodiment of a display element to be utilized in conjunction with a medal display, according to the presently disclosed systems, methods, and/or apparatuses.
Figure 22:
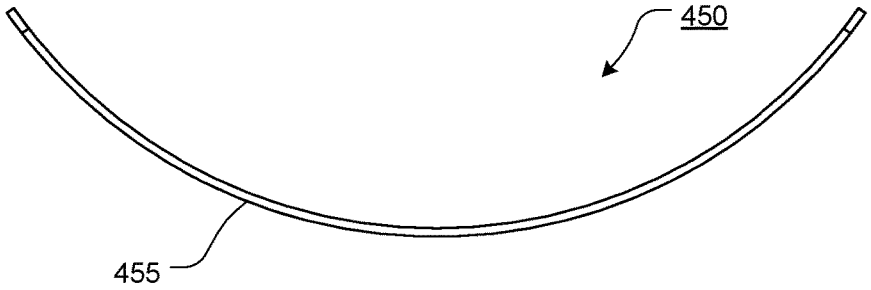
FIG. 22 illustrates a top view of an exemplary embodiment of a display element to be utilized in conjunction with a medal display, according to the presently disclosed systems, methods, and/or apparatuses.
Figure 23:
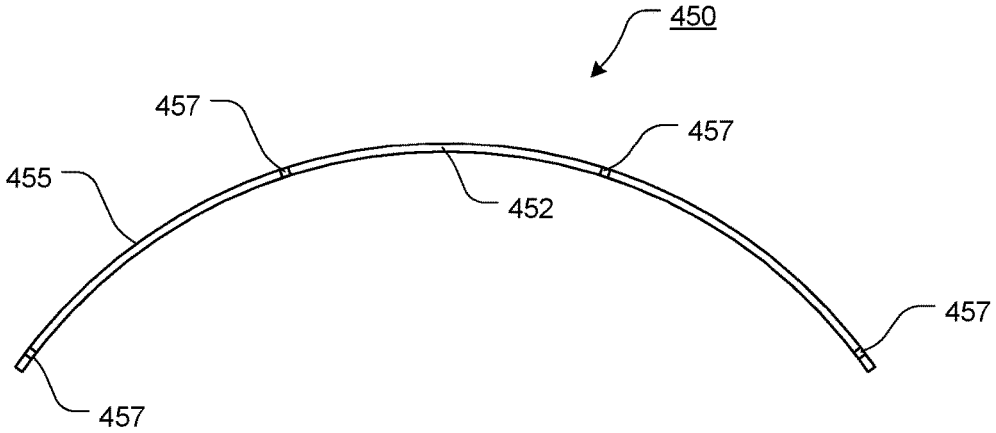
FIG. 23 illustrates a bottom view of an exemplary embodiment of a display element to be utilized in conjunction with a medal display, according to the presently disclosed systems, methods, and/or apparatuses.

Turning now to the appended drawing figures, FIGS. 1-6 illustrate certain elements and/or aspects of an exemplary embodiment of the medal display 100, FIGS. 7-9 illustrate certain elements and/or aspects of an exemplary embodiment of the medal display 200, according to the present disclosure FIGS. 10-14 illustrate certain elements and/or aspects of an exemplary embodiment of the medal display 200, FIGS. 15-24 illustrate certain elements and/or aspects of an exemplary embodiment of a display element 450 to be utilized in conjunction with the medal display 100, 200, and/or 300.

In certain illustrative, non-limiting embodiment(s) of the present disclosure, as illustrated most clearly in FIGS. 1-6, the medal display 100 comprises a portion of material forming a display base 105. The display base 105 includes a first side 101 and a second side 102 and extends from a proximate center to an outer edge 103. Optionally, a central aperture 127 is provided in the center of the display base 105. In various exemplary embodiments, the display base 105 has a substantially circular overall shape. However, it should be appreciated that the overall size, shape, and appearance of the display base 105 is a design choice. Thus, it should be understood that the display base 105 may have a substantially round, oval, triangular, square, rectangular, or other geometrically defined or unique overall shape.

A plurality of elongate slots 110 are formed through the display base 105. Each of the elongate slots 110 is formed so as to allow at least a portion of a ribbon, lanyard, cord, or other suspension element (hereinafter referred to as a "lanyard" or "medal lanyard") to pass therethrough. Each of elongate slots 110 is illustrated as having an elongate, substantially rounded rectangular overall shape, it should be appreciated that the number and overall size and shape of each elongate slot 110 is a design choice, based upon the desired number, size, and location of elongate slots 110 of the display base 105. Thus, it should be understood that each elongate slot 110 may have an overall round, oval, triangular, square, rectangular, or other defined or unique shape.

The elongate slots 110 are formed in adjacent pairs of substantially parallel elongate slots 110. By forming the elongate slots 110 in adjacent pairs, a lanyard can be positioned through the adjacent elongate slots 110. For example, an end portion of a lanyard 18 can be urged upward, through one of the adjacent elongate slots 110 and then downward, through the paired, adjacent elongate slot 110.

As illustrated, the adjacent, corresponding pairs of elongate slots 110 are formed so as to extend radially from a center of the display base. In various exemplary embodiments, the corresponding pairs of elongate slots are arranged at spaced apart locations so as to form an outer slot arrangement 113 (as highlighted by a first shaded area in FIG. 1) and an inner slot arrangement 112 (as highlighted by a second shaded area in FIG. 1). The outer slot arrangement 113 comprises a plurality of adjacent pairs of elongate slots 110 formed in a spaced apart circular arrangement proximate the outer edge 103 of the display base 105. The inner slot arrangement 112 comprises a plurality of adjacent pairs of elongate slots 110 formed in a substantially circular arrangement proximate the center of the display base 105. As illustrated, the inner slot arrangement 112 and the outer slot arrangement 113 form concentric circles, with the inner slot arrangement 112 being disposed within the outer slot arrangement 113.

One or more accessory slots 120 are optionally formed through the display base 105 at spaced apart locations, proximate the outer edge 103 of the display base 105. If included, each accessory slot 120 is formed so as to interact with a projection or other device of an accessory to allow the accessory to be attached or coupled to the display base 105. While the accessory slots 120 are illustrated as comprising apertures partial aperture is formed through the display base 105, it should be appreciated that the accessory slots 120 may optionally comprise projections or other devices, such as for example, magnets or portions of ferrous materials formed in, on, or through the display base 105 or extending from the first side 101 and/or second side 100 to of the display base 105.

One or more attachment elements 117 are formed in, on, or through the display base 105. In certain exemplary embodiments, as illustrated, the attachment elements 117 comprise at least one hole or aperture formed through the display base 105. The attachment elements 117 are formed such that one or more suspension cords 150, as illustrated most clearly in FIG. 6, may be positioned through or interact with the attachment elements 117, such that the display base 105 can be suspended from the one or more suspension cords 150.

As further illustrated in FIG. 6, the suspension cords 150 may optionally be attached or coupled to a suspension ring 152. If included, the suspension ring 152 or other attachment device allows the suspension cords 150 and, in turn, the display base 105 to be conveniently suspended from a hook or other attachment element. In various exemplary embodiments, the suspension cords 150 comprise a cord, chain, wire, string, or other similar item for suspending the display base 105.

In certain exemplary, nonlimiting embodiments, the display base 105 may optionally be formed of a transparent, semitransparent, translucent, clear, colored, or semi-opaque material. The display base 105 may optionally be formed of glass, toughened glass, sapphire glass, tempered glass, safety glass, an acrylic, Poly(methyl methacrylate), a Polycarbonate, a thermoplastic, a glass-hardened polymer, a polymeric composite, or a high-strength or shatter-resistant glass or plastic.

Alternatively, the display base 105 may be substantially rigid and may be formed of steel, aluminum, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, or polymer fiber reinforced plastics, thermoform and/or thermoset materials, and/or various combinations of the foregoing. Thus, it should be understood that the material or materials used to form the display base 105 is a design choice based on the desired appearance and/or functionality of the display base 105.

During assembly and use, as illustrated in FIG. 6, the suspension cords 150 may optionally be suspended from the suspension ring 152. The suspension cords 150 are attached or coupled to or through respective attachment elements 117. In this manner, the medal display 100 can be suspended for display.

During attachment of a ribbon medal to the medal display 100, as illustrated in FIGS. 5 and 6, an end portion of the lanyard 18 is urged upward, from the second side 102, through an elongate slot 110. The end portion is then folded over and urged downward, from the first side 101, through an adjacent, paired elongate slot 110. Once the end portion of the lanyard 18 is urged through the second side 102, a loop of the end portion of the lanyard 18 is opened and the medal 15 is pulled through the open loop of the lanyard 18. The medal 15 is then pulled away from the display base 105 in the loop of the lanyard 18 is pulled tight to the second side 102 of the display base 105. In this manner, a medal 15, having an associated lanyard 18 can be suspended from the display base 105, adjacent pairs of elongate slots 110.

It should be appreciated that a plurality of ribbon medals can be attached, utilizing adjacent, paired elongate slots 110, around the elongate slots 110 of the outer slot arrangement 113 and/or the inner slot arrangement 112.

Once a sufficient number of ribbon medals have been attached to the display base 105, motion of the display base 105 causes adjacent medals 15 to contact one another, creating a wind chime. In certain exemplary embodiments, one or more round or other discs 140 may optionally be suspended through or from the central aperture 127 to provide an additional ornamental display to the medal display 100 or to create further action between the medals 15 to heighten the wind chime effect of the display base 105.

FIGS. 7-9, illustrate certain elements and/or aspects of an exemplary embodiment of a medal display 200, according to the presently disclosed systems, methods, and/or apparatuses. As illustrated in FIGS. 7-9, the medal display 200 comprises at least some of an outer display base 206 having a first side 201 and a second side 202, an inner display base 209, elongate slots 210 arranged in an outer slot arrangement 213 and an inner slot arrangement 212, attachment elements 217, a central aperture 227, suspension cords 250, and a suspension ring 252.

It should be understood that each of these elements corresponds to and operates similarly to the display base 105, the first side 101, the second side 102, the elongate slots 110, the outer slot arrangement 113, the inner slot arrangement 112, the attachment elements 117, the central aperture 127, the suspension cords 150, and the suspension ring 152, as described above with reference to the medal display 100 of FIGS. 1-6.

However, as illustrated in FIGS. 7-9, the display base 105 is replaced with an outer display base 217 and an inner base 209. The outer display base 206 extends from an outer edge 203 to an inner edge 204. The outer slot arrangement 213 of elongate slots 210 is positioned about the outer display base 206.

The inner display base 209 extends from the central aperture 227 to an open edge 208. In certain exemplary embodiments, the outer edge 208 of the inner display base 209 is formed so as to be fitted within the inner edge 204 of the outer display base 206.

While the outer edge 203 of the outer display base 206 and the outer edge 208 of the inner display base 209 are illustrated as comprising substantially hexagonal outer edges, it should be appreciated that this is illustrative and not limiting. Therefore, the outer edge 203 of the outer display base 206 and the outer edge 208 of the inner display base 209 they have any desired shape and may have corresponding or dissimilar overall shapes or perimeters.

The medal display 200 also includes additional, outer attachment elements 218 formed proximate the outer edge 203 of the outer display base 206 and inner attachment elements 219 formed proximate the inner edge 204 of the outer display base 206.

By utilizing the attachment elements 217, outer attachment elements 218, and inner attachment elements 219, the inner display base 209 can be suspended, via suspension cords 255, from the outer display base 206, as illustrated in FIG. 9. The medal display 200 may also incorporate one or more discs 240, corresponding to the one or more discs 140.

FIGS. 10-14, illustrate certain elements and/or aspects of an exemplary embodiment of a medal display 300, according to the presently disclosed systems, methods, and/or apparatuses. As illustrated in FIGS. 10-14, the medal display 300 comprises at least some of a display base 305 having a first side 301 and a second side 302, elongate slots 310 arranged in an outer slot arrangement 313 and an inner slot arrangement 312, and a central aperture 327.

It should be understood that each of these elements corresponds to and operates similarly to the display base 105, the first side 101, the second side 102, the elongate slots 110, the outer slot arrangement 113, the inner slot arrangement 112, and the central aperture 127, as described above with reference to the medal display 100 of FIGS. 1-6.

However, as illustrated in FIGS. 10-14, the display base 305 forms a semi-circle with an attachment base 330 extending therefrom. The attachment base 330 includes attachment elements 317 formed therethrough. As illustrated, the attachment elements 317 form keyhole type aperture is formed through the attachment base 330. Thus, fasteners or other elements can be used in conjunction with the attachment elements 317 2 attached or coupled the medal display 300 to a wall or other surface.

In various exemplary embodiments, a plane formed by the attachment base 330 is formed at a 90° angle, e, relative to a plane formed by the first side 301 or the second side 302 of the display base 305. Alternatively, a plane formed by the attachment base 330 may optionally be formed at an obtuse or acute angle, e, relative to a plane formed by the first side 301 or the second side 302 of the display base 305.

FIGS. 15-24, illustrate certain elements and/or aspects of an exemplary embodiment of a display 450 that can be utilized in conjunction with any of the medal displays 100, 200, or 300, according to the presently disclosed systems, methods, and/or apparatuses. As illustrated in FIGS. 15-24, the display 450 comprises a curved or arcuate portion of material having at least one display surface 455. The display surface 455 may comprise a blank or substantially blank surface, which allows a user to affix stickers or apply artwork to the display surface 455. Alternatively, the display surface 455 may include certain indicia applied to or embedded in the display surface 455. In certain exemplary embodiments, the indicia may represent a trademark or other word, phrase, or element, thereby providing additional ornamentation or originality to the display surface 455.

Figure 24:
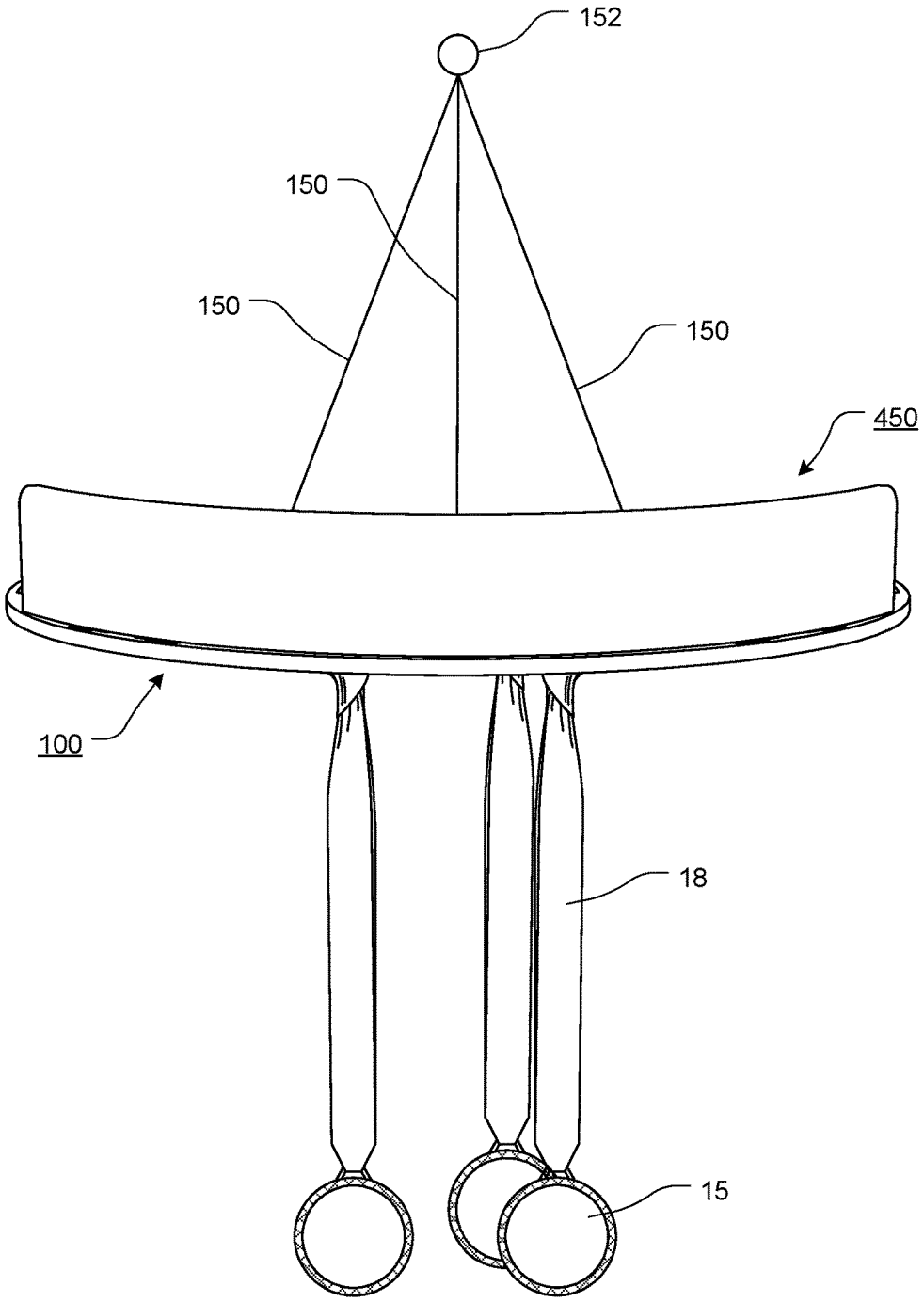
FIG. 24 illustrates a front perspective view of an exemplary embodiment of a display element attached or coupled to a medal display, according to the presently disclosed systems, methods, and/or apparatuses.

One or more attachment projections 457 extend from a bottom edge 452 of the display 450. The attachment projections 457 are formed so as to interact with the accessory slots 120, 220, or 320 to help secure the display 452 a medal display 100, 200, or 300, respectively. FIG. 24 illustrates an exemplary embodiment of a display 450 attached or coupled to an exemplary medal display 100.

It should be appreciated that the overall size and shape of the display 450 is a design choice and may be formed so as to correspond to a shape or a portion of a shape of a medal display 100, 200, or 300, with which the display 450 is to be utilized.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A medal display, comprising:

a circular and generally planar display base having a center and a circumference;

a plurality of elongate slots formed through said display base, wherein said elongate slots are formed in corresponding, adjacent pairs of substantially parallel elongate slots, wherein said corresponding, adjacent pairs of elongate slots are arranged at spaced apart locations so as to form an outer slot arrangement and an inner slot arrangement; and wherein each corresponding, adjacent pair of elongate slots is configured to receive a lanyard having a ribbon medal thereon in order to suspend the lanyard and medal from said display base for display;

where an arcuate shaped border wall is removably attached to the display base proximate to the circumference of the display base; wherein the border wall extends upwardly from the display base and the border wall defines a first arc having a first length, wherein the first arc is similar to a second arc of the circumference;

wherein the first length of the border wall is less than the circumference of the display base;

one or more attachment elements formed in, on, or through said display base, wherein suspension cords are attached to the attachment elements and extend upwardly therefrom above the display base to suspend the display base from a support surface that is above the display base.

2. The medal display of claim 1, wherein a central aperture is formed proximate to said center of said display base.

3. The medal display of claim 1, wherein each elongate slot has a generally round, oval, triangular, square, or rectangular shape.

4. The medal display of claim 1, wherein each elongate slot is extends radially from said center of said display base.

5. The medal display of claim 1, wherein said corresponding, adjacent pairs of elongate slots extend radially from said center of said display base.

6. The medal display of claim 1, wherein said plurality of corresponding, adjacent pairs of elongate slots of said outer slot arrangement are formed in a spaced apart circular arrangement proximate said circumference of said display base.

7. The medal display of claim 1, wherein said plurality of corresponding, adjacent pairs of elongate slots of said inner slot arrangement are formed in a substantially circular arrangement proximate to said center of said display base.

8. The medal display of claim 1, wherein said inner slot arrangement and said outer slot arrangement form concentric circles, with said inner slot arrangement being disposed interior with respect to said outer slot arrangement.

9. The medal display of claim 1, further comprising one or more accessory slots formed through said display base at spaced apart locations proximate to said circumference of said display base, wherein each accessory slot is formed so as to interact with a portion of the border wall to attach or couple the border wall to said display base.

10. The medal display of claim 2, wherein one or more discs are configured to be suspended through or from said central aperture.

11. The medal display of claim 1, wherein, when in use, movement of a portion of the lanyard can be inhibited by passing the medal through a loop of an end portion of said lanyard.

12. The medal display of claim 9, wherein at least a portion of said border wall is configured to interact with said accessory slots to attach or couple said border wall to said display base.

13. The medal display of claim 1, wherein the border wall is a sign.

* * * * *